US011441564B2

(12) United States Patent
Rong et al.

(10) Patent No.: US 11,441,564 B2
(45) Date of Patent: Sep. 13, 2022

(54) DRIVING STRUCTURE OF THREE-AXIS MULTI-STAGE ROOTS PUMP

(71) Applicant: OVG VACUUM TECHNOLOGY (SHANGHAI) CO., LTD., Shanghai (CN)

(72) Inventors: Yi Rong, Shanghai (CN); Yue Li, Shanghai (CN); Miaole Shen, Shanghai (CN)

(73) Assignee: OVG VACUUM TECHNOLOGY (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/706,691

(22) Filed: Dec. 7, 2019

(65) Prior Publication Data

US 2021/0088044 A1 Mar. 25, 2021

(30) Foreign Application Priority Data

Sep. 23, 2019 (CN) ..... 201910901006.9

(51) Int. Cl.
*F04C 27/00* (2006.01)
*F04C 29/02* (2006.01)
(Continued)

(52) U.S. Cl.
CPC ..... *F04C 27/00* (2013.01); *F04C 18/086* (2013.01); *F04C 18/126* (2013.01);
(Continued)

(58) Field of Classification Search
CPC ..... F04C 18/126; F04C 2240/30; F04C 2240/50; F04C 23/001; F04C 27/00; F04C 2240/60; F04C 2240/605
See application file for complete search history.

(56) References Cited

U.S. PATENT DOCUMENTS 2,694,978 A 11/1954 Berry
4,022,553 A 5/1977 Poole et al. ..... 418/183
(Continued)

FOREIGN PATENT DOCUMENTS

CN 2667203 Y 12/2004 ..... F04C 18/08
CN 201396281 Y 2/2010 ..... F04C 18/14
(Continued)

OTHER PUBLICATIONS

Machine translation of CN-107420306-A, Title: Triaxial Modularized Dry Type Vacuum Pump; Inventor: Rong; Published Dec. 2017. (Year: 2017).*

*Primary Examiner* — Mary Davis
(74) *Attorney, Agent, or Firm* — Renner, Kenner, Greive, Bobak, Taylor & Weber

(57) ABSTRACT

A driving structure of a three-axis multi-stage Roots pump comprises a pump body, wherein a gear end cover is mounted at one side of the pump body, an air outlet end moving bearing air sealing unit is mounted on the other side of the pump body, and the bearing end cover is mounted on the pump at the side of the pump body; a driving axis, a first driven axis and a second driven axis are further provided inside the pump body, and the driving axis is connected with the first driven axis and the second driven axis through the gear, respectively; and both ends of the driving axis, the first driven axis and the second driven axis are movably connected to an air inlet end gear mechanical seal driving unit and an air outlet end moving bearing air sealing unit, respectively. The present invention overcomes the deficiencies of the prior art, a fixed bearing limiting unit not only plays a radial supporting role, strengthens the rigidity of an independent axis, but also reduces the diameter of the axis, and at the same time, evenly distributes to the two axial ends in the axial deformation process, avoiding deformation in a
(Continued)

single direction, reducing the amount of displacement by nearly half, and also improving the sealing efficiency of the system.

10 Claims, 4 Drawing Sheets

(51) Int. Cl.
*F04C 23/00* (2006.01)
*F04C 18/12* (2006.01)
*F04C 18/08* (2006.01)
*F04C 18/16* (2006.01)

(52) U.S. Cl.
CPC ..... *F04C 18/165* (2013.01); *F04C 23/001* (2013.01); *F04C 29/02* (2013.01); *F04C 2240/30* (2013.01); *F04C 2240/50* (2013.01); *F04C 2240/60* (2013.01); *F04C 2240/605* (2013.01); *F04C 2240/80* (2013.01)

(56) References Cited

U.S. PATENT DOCUMENTS

| | | | | |
|---|---|---|---|---|
| 4,595,349 | A | 6/1986 | Preston et al. | 418/206 |
| 4,995,796 | A | 2/1991 | Kambe et al. | 418/9 |
| 5,090,879 | A | 2/1992 | Weinbrecht | 418/9 |
| 5,335,640 | A | 8/1994 | Feuling | 123/559.1 |
| 7,255,541 | B2 | 8/2007 | Kuramoto et al. | 417/410.3 |
| 8,082,784 | B2 | 12/2011 | Grzeslo | 73/261 |
| 8,215,937 | B2 | 7/2012 | Inagaki et al. | 418/206.7 |
| 8,308,458 | B2 | 11/2012 | Kettlewell et al. | 418/19 |
| 8,500,422 | B2 | 8/2013 | Dowdeswell et al. | 418/9 |
| 8,579,601 | B2 | 11/2013 | Kim | 417/251 |
| 9,062,675 | B2 | 6/2015 | Dixon et al. | F04C 15/0015 |
| 9,080,571 | B2 | 6/2015 | Downham et al. | F04C 29/04 |
| 9,745,978 | B2 | 8/2017 | Kobus et al. | F04C 15/0096 |
| 10,738,778 | B2 | 8/2020 | Hirano et al. | F04C 18/126 |
| 2005/0069440 | A1 | 3/2005 | Naito | 418/9 |
| 2006/0222506 | A1 | 10/2006 | Rival | 417/2 |
| 2010/0135839 | A1 | 6/2010 | Fraser | 418/197 |
| 2017/0298733 | A1 | 10/2017 | Williams et al. | F01C 1/126 |
| 2019/0309756 | A1 | 10/2019 | Shaw et al. | F04D 15/0011 |

FOREIGN PATENT DOCUMENTS

| | | | | | |
|---|---|---|---|---|---|
| CN | 101985935 | B | | 3/2011 | F04C 18/14 |
| CN | 101985937 | B | | 3/2011 | F04C 18/14 |
| CN | 102828952 | B | | 12/2012 | F04C 25/02 |
| CN | 202690445 | U | | 1/2013 | F04C 23/00 |
| CN | 202851357 | U | | 4/2013 | F04C 18/14 |
| CN | 202867219 | U | | 4/2013 | F04C 18/14 |
| CN | 103089647 | B | | 5/2013 | F04C 18/14 |
| CN | 103486034 | B | | 1/2014 | F04C 25/02 |
| CN | 105222980 | B | | 1/2016 | G01M 9/04 |
| CN | 205383080 | U | | 7/2016 | F04C 23/02 |
| CN | 105864036 | A | | 8/2016 | F04C 18/12 |
| CN | 205779709 | U | | 12/2016 | F04C 23/00 |
| CN | 106499631 | A | | 3/2017 | F04C 18/12 |
| CN | 106949050 | B | | 7/2017 | F04C 18/12 |
| CN | 107061284 | A | | 8/2017 | F04C 25/02 |
| CN | 206377025 | U | | 8/2017 | F04C 18/04 |
| CN | 107420306 | A | * | 12/2017 | |
| CN | 108317080 | A | | 7/2018 | F04C 18/12 |
| CN | 108799112 | B | | 11/2018 | F04C 18/12 |
| CN | 108953146 | A | | 12/2018 | F04C 18/12 |
| CN | 109026710 | A | | 12/2018 | F04C 18/12 |
| CN | 109058110 | A | | 12/2018 | F04C 18/12 |
| CN | 209414166 | U | | 9/2019 | F04C 23/00 |
| EP | 0953771 | A1 | | 11/1999 | F04C 23/00 |
| EP | 2461040 | A1 | | 6/2012 | F04C 18/12 |
| EP | 3434905 | A1 | | 1/2019 | F04D 19/04 |
| GB | 2417757 | A | | 3/2006 | F04C 18/14 |
| JP | 3-145594 | | | 6/1991 | F04C 29/04 |
| JP | 2009287579 | A | | 12/2009 | F16D 1/09 |
| WO | WO2020/160770 | A1 | | 8/2020 | F01C 21/10 |

* cited by examiner

DRIVING STRUCTURE OF THREE-AXIS MULTI-STAGE ROOTS PUMP

TECHNICAL FIELD

The present invention relates to the technical field of Roots pumps, in particular to a driving structure of a three-axis multi-stage Roots pump.

BACKGROUND

The three-axis multi-stage Roots pump is a new oil-free dry vacuum pump. The pump chamber at each stage is provided with three parallel axes. The three pump axes rotate at the same speed, and the center pump axis rotates in the direction opposite to the direction in which its adjacent left pump axis and its adjacent right pump axes rotate; the pump chamber at each stage is provided with a pair of rotors. The pairs of rotors of an odd-numbered-stage pump chamber are connected to the center pump axis and its adjacent left pump axis, respectively. The pairs of rotors of an even-numbered-stage pump chamber are connected to the center pump axis and its adjacent right pump axis, respectively. In such a way, a unique airflow passage is formed, that is, the lower ports of the adjacent pump chambers are an air outlet and an air inlet, respectively, and the airflow directly enters the air inlet at the latter stage from the air outlet at the previous stage. This unique structure has advantages of large pumping capacity, high volumetric efficiency, low power, no fear of dust, no fear of corrosion, and long service life compared to screw, scroll, reciprocating and other dry vacuum pumps.

However, the existing three-axis multi-stage Roots pump has a complicated driving structure, relatively complicated, that is, the pump chamber at each stage adopts three independent axes. The axes between adjacent stages are snap-nested, and are in a sliding connection. The key realizes concentric and synchronous rotation. Each independent axis adopts a fixed bearing limit, and the axis in the pump chamber of different stages is independent thermal expansion displacement. In actual operation, due to the large number of parts and the complicated structure, the cumulative error is very large and cannot be eliminated, resulting in low meshing degree of rotors in the multi-stage pump chamber. It is easy to cause rubbing, and each independent axis needs a fixed bearing limit. There are too many bearings, and great noise occurs when rotating at a high speed. Moreover, the axes between different stages are snap-nested, and the strength is insufficient. The transmission of the torque of the mother axis and the child axis will easily cause the fracture of the root of the child axis.

SUMMARY

In view of the deficiencies of the prior art, the present invention provides a driving structure of a three-axis multi-stage Roots pump, which overcomes the deficiencies of the prior art and has a reasonable design. The first driven axis and the second driven axis on the left and right sides are driven to synchronously rotate by the gears on the driving axis, which in turn drives the first driven axis and the second driven axis to rotate, and the three complete independent axes, that is, the driving axis, the first driven axis and the second driven axis, synchronously rotate. A fixed bearing limiting unit is provided, which not only plays a radial supporting role, strengthens the rigidity of an independent axis, but also reduces the diameter of the axis, and at the same time, evenly distributes to the two axial ends in the force and thermal axial deformation process, avoiding deformation in a single direction, reducing the amount of displacement by nearly half, greatly reducing the end face gap reserved between the rotor and the rotor chamber in the rotor pump chamber, thereby not only improving the stability of the structure, reducing the hidden danger of the rubbing, but also improving the sealing efficiency of the system.

To achieve the above object, the present invention is achieved by the following technical solutions:

A driving structure of a three-axis multi-stage Roots pump, comprising a pump body, wherein: one side of the pump body is mounted with an air inlet end gear mechanical seal driving unit, a gear end cover is mounted on an outer surface of the air inlet end gear mechanical seal driving unit, the gear end cover is fixedly mounted on a side end surface of the pump body, a motor connecting base is fixedly mounted on the outer surface of the gear end cover, the other side of the pump body is mounted with an air outlet end moving bearing air sealing unit, a bearing end cover is mounted on the outer surface of the air outlet end moving bearing air sealing unit, and the bearing end cover is fixedly mounted on a side end surface of the pump body; the pump body is further provided with a driving axis, a first driven axis and a second driven axis, the first driven axis and the second driven axis are located at both sides of the driving axis, respectively, the outer surface of the driving axis is fixedly mounted with a gear, the driving axis is in transmission connection with the first driven axis and the second driven axis through the gear, respectively; one end of the driving axis, the first driven axis and the second driven axis is movably connected to a set of air inlet end gear mechanical seal driving units, respectively, and the other end of the driving axis, the first driven axis and the second driven axis is movably connected to the set of air outlet end moving bearing air sealing units, respectively.

Preferably, the pump body comprises a first-stage pump housing, a second-stage pump housing and a three-stage pump housing, the first-stage pump housing, the second-stage pump housing and the third-stage pump housing are sequentially fixedly connected, the gear end cover is fixedly mounted on the outer surface of the first-stage pump housing, the bearing end cover is fixedly mounted on the outer surface of the third-stage pump housing, the first-stage pump housing is provided with a first-stage rotor pump chamber, the second-stage pump housing is provided with a two-stage rotor pump chamber and a three-stage rotor pump chamber, the three-stage pump housing is provided with a four-stage rotor pump chamber and a five-stage rotor pump chamber, and the rotors in the first-stage rotor pump chamber, the two-stage rotor pump chamber, the three-stage rotor pump chamber, the four-stage rotor pump chamber and the five-stage rotor pump chamber are all mounted on the driving axis, the first driven axis and the second driven axis.

Preferably, the air inlet end gear mechanical seal driving unit comprises a gear base, a mechanical sealing base, a mechanical seal ring and a sealing bushing, the mechanical sealing base is fixedly mounted on the gear end cover by bolts, the mechanical seal ring is mounted on the sealing bushing, each sealing bushing is movably connected to the driving axis, the first driven axis and the second driven axis, respectively, a first roller bearing is fixed in the mechanical sealing base, one side of the first roller bearing is abutted against the sealing bushing, the other side of the first roller bearing is abutted against the gear base, the gear base is fixed by a first lock nut and is limited to the end of the driving axis, and the gear is fixedly mounted to the gear base by bolts.

Preferably, the gear base is fixed with one end of the driving bushing by bolts and uses a positioning and matching concentric axis for limit with the driving bushing, the other end of the driving bushing is matched with a motor connecting axis and a axis key through a keyway, and the motor connecting axis is in transmission connection with the driving axis.

Preferably, the driving bushing is in sealed connection with the motor connecting base through a third lip seal.

Preferably, the moving bearing air sealing unit comprises a dust shielding base, a dust shielding bushing, a bearing gland and a bearing base, the dust shielding base is fixedly mounted on the bearing end cover and cooperates with the dust shielding bushing, the dust shielding bushing is sleeved on the driving axis, the first driven axis and the second driven axis, respectively, a gap is provided between the dust shielding base and the dust shielding bushing, an air seal passage is provided on the bearing base, the air seal passage is communicated with the gap, a first lip seal is provided between the bearing base and the dust shielding bushing, and the bearing gland is fixedly mounted on the outer surface of the bearing base.

Preferably, a second roller bearing is fixed in the bearing base, one side of the second roller bearing is abutted against the dust shielding bushing, the other side of the second roller bearing is defined by a second lock nut, and the second lock nut is fixedly sleeved on the driving axis, the first driven axis and the second driven axis, respectively.

Preferably, the driving structure of a three-axis multi-stage Roots pump further comprises a fixed bearing limiting unit, wherein the bearing limiting unit is provided in the first-stage pump housing, the fixed bearing limiting unit comprises a ball bearing and a bearing chamber grease shielding ring, one end of the outer circumference of the ball bearing is defined in the first-stage pump housing, the other end of the outer circumference of the ball bearing is fixed with a bearing chamber grease shielding base, the bearing chamber grease shielding base is defined and fixed by the first-stage pump housing, one end of the inner circumference of the ball bearing is abutted against the bearing chamber grease shielding ring, the bearing chamber grease shielding ring is defined by the axis steps on the surface of the driving axis, the first driven axis, and the second driven axis, the other end of the inner circumference of the ball bearing is defined by a second lock nut, and the second lock nut is fixedly mounted on the outer surface of the driving axis, the first driven axis and the second driven axis, respectively.

Preferably, a second lip seal is mounted between the bearing chamber grease shielding ring and the first-stage pump housing.

Preferably, the surface of the bearing chamber grease shielding base is provided with a guiding notch, the first-stage pump housing is provided with a lubricating grease inspection hole, and the lubricating grease inspection injection hole is communicated with the guiding notch.

The present invention provides a driving structure of a three-axis multi-stage Roots pump, and has the following beneficial effects: the first driven axis and the second driven axis on the left and right sides are driven to synchronously rotate by the gears on the driving axis, which in turn drives the first driven axis and the second driven axis to rotate, and the three complete independent axes, that is, the driving axis, the first driven axis and the second driven axis, synchronously rotate. A fixed bearing limiting unit is provided, which not only plays a radial supporting role, strengthens the rigidity of an independent axis, but also reduces the diameter of the axis, and at the same time, evenly distributes to the two axial ends in the force and thermal axial deformation process, avoiding deformation in a single direction, reducing the amount of displacement by nearly half, greatly reducing the end face gap reserved between the rotor and the rotor chamber in the rotor pump chamber, thereby not only improving the stability of the structure, reducing the hidden danger of the rubbing, but also improving the sealing efficiency of the system.

BRIEF DESCRIPTION OF THE DRAWINGS

In order to more clearly illustrate the present invention or the technical solutions in the prior art, the drawings used in the description of the prior art will be briefly described below.

DESCRIPTION OF THE REFERENCE SIGNS IN THE FIGURE

1, a pump body; 2, an air inlet end gear mechanical seal driving unit; 3, a gear end cover; 4, a motor connecting base; 5, an air outlet end moving bearing air sealing unit; 6, a bearing end cover; 7, a driving axis; 8, a first driven axis; 9, a second driven axis; 10, a gear; 11, a first-stage pump housing; 12, a two-stage pump housing; 13, a three-stage pump housing; 14, a first-stage rotor pump chamber; 15, a two-stage rotor pump chamber; 16, a three-stage rotor pump chamber; 17, a four-stage rotor pump chamber; 18, a five-stage rotor pump chamber; 19, a gear base; 20, a mechanical sealing base; 21, a mechanical seal ring; 22, a sealing bushing; 23, a first roller bearing; 24, a first lock nut; 25, a driving bushing; 26, a motor connecting axis; 27, a dust shielding base; 28, a dust shielding bushing; 29, a bearing gland; 30, a bearing base; 31, a second roller bearing; 32, a first lock nut; 33, a first lip seal; 34, a fixed bearing limiting unit; 35, a ball bearing; 36, a bearing chamber grease shielding base; 37, a bearing chamber grease shielding ring; 38, a second lip seal; 39, a lubricating grease inspection hole; 40, a third lip seal; 41, a gear lubricating oil tank; 42, a second lock nut.

DESCRIPTION OF THE EMBODIMENTS

In order to make the object, the technical solution and the advantage of the present invention clearer, the technical solution in the present invention will be clearly and completely described below in conjunction with the drawings in the present invention.

Figure 1:
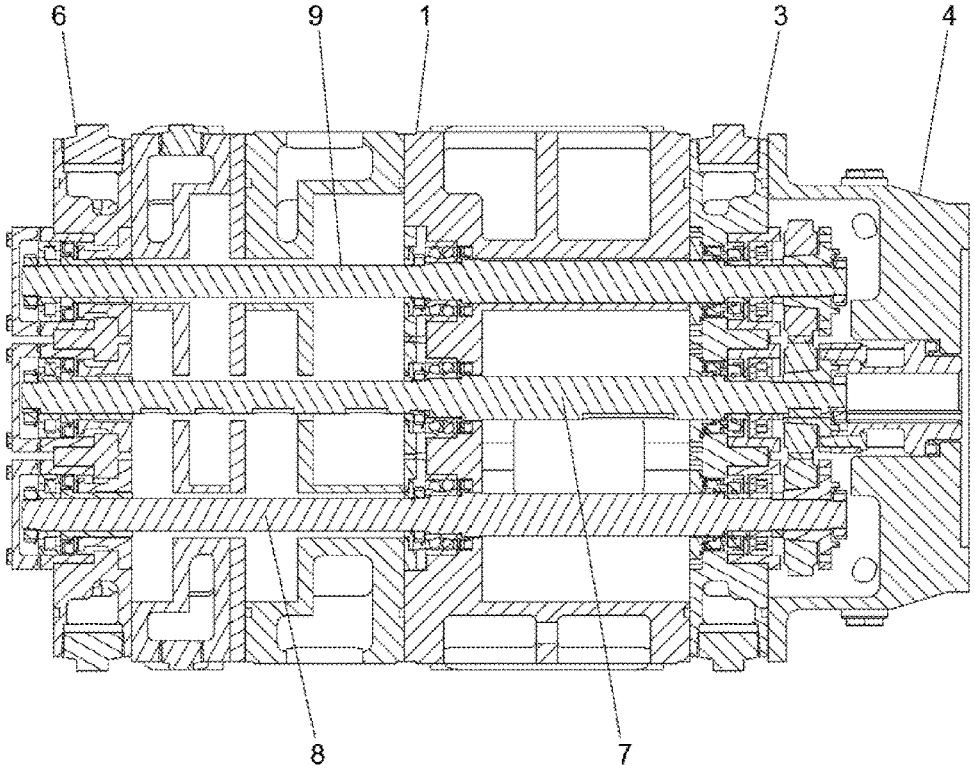
FIG. 1 is a plan cross-sectional diagram of the present invention.
Figure 2:
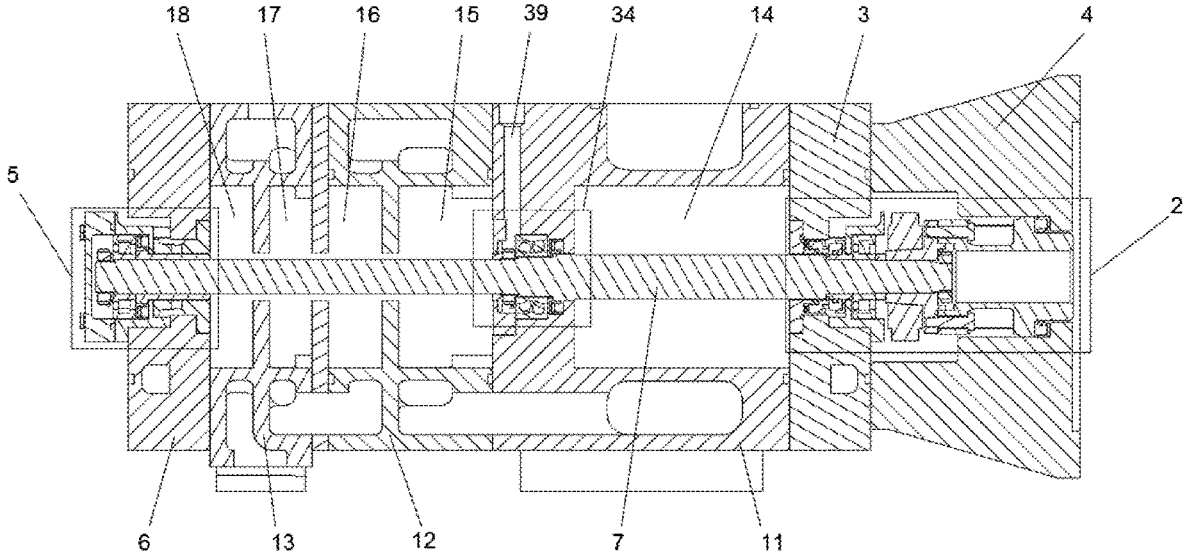
FIG. 2 is a perspective cross-sectional diagram of the present invention.
Figure 3:
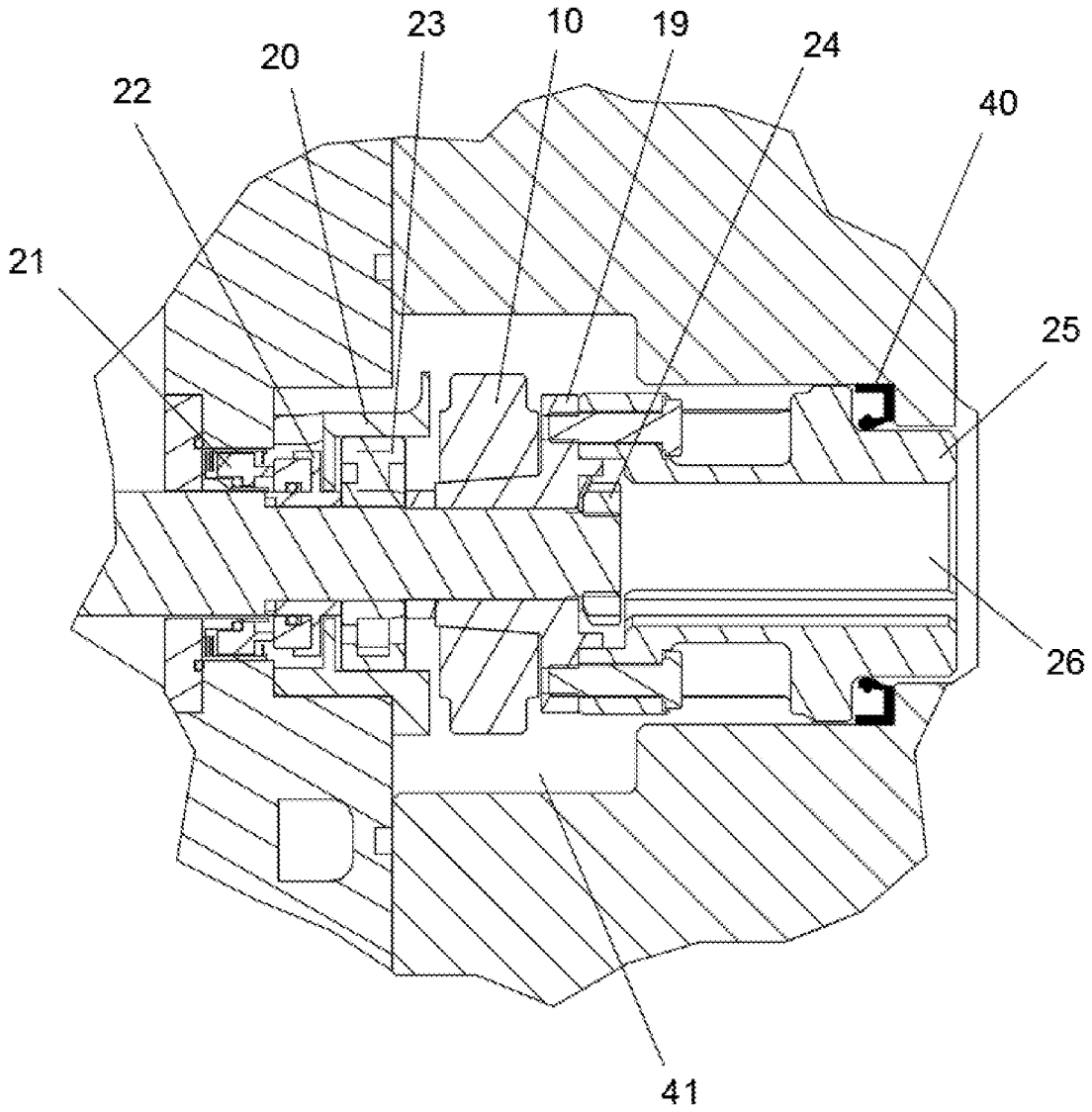
FIG. 3 is a cross-sectional diagram illustrating an air inlet end gear mechanical seal driving unit according to the present invention.
Figure 4:
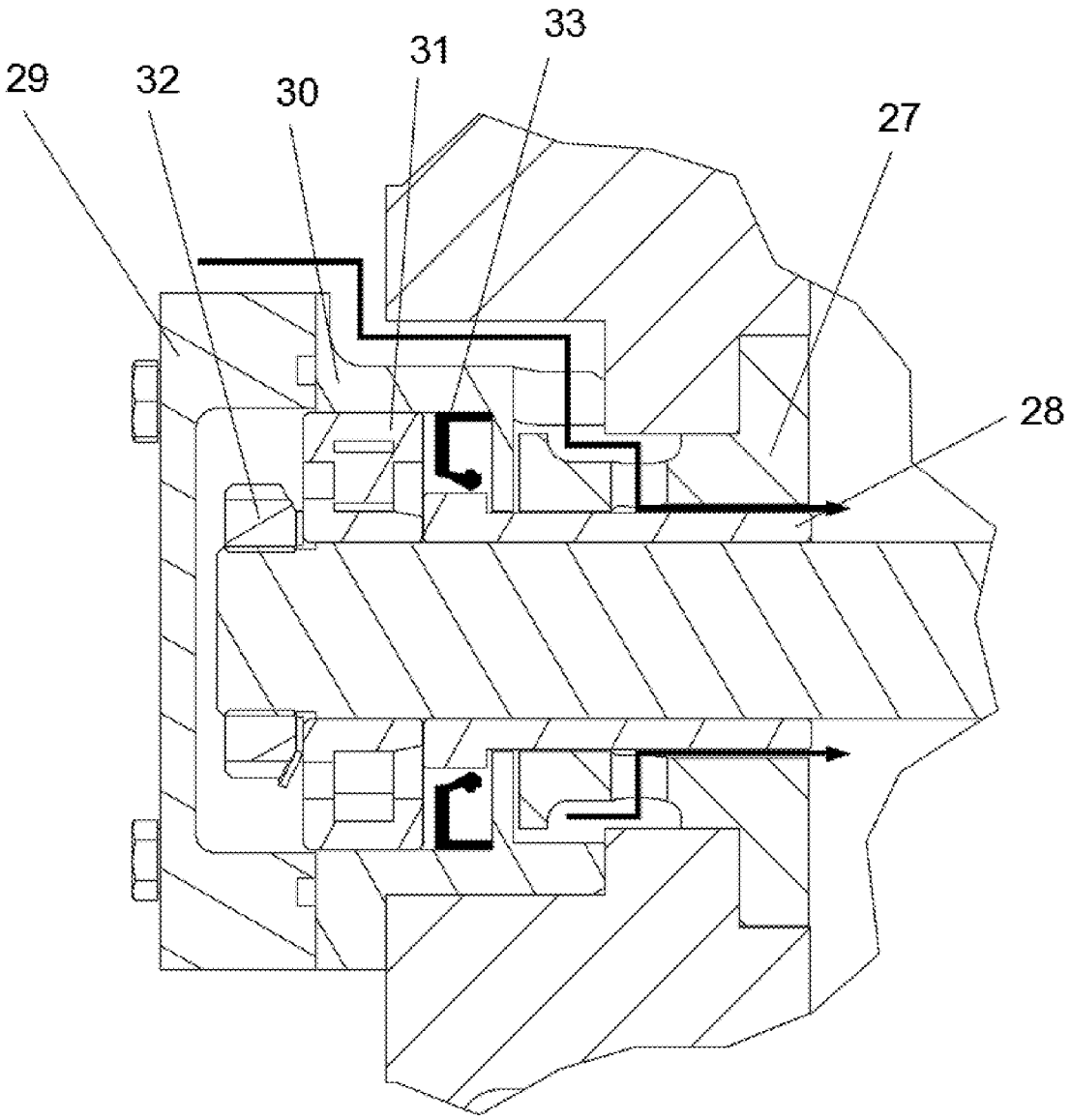
FIG. 4 is a cross-sectional diagram illustrating an air outlet end moving bearing air sealing unit according to the present invention.
Figure 5:
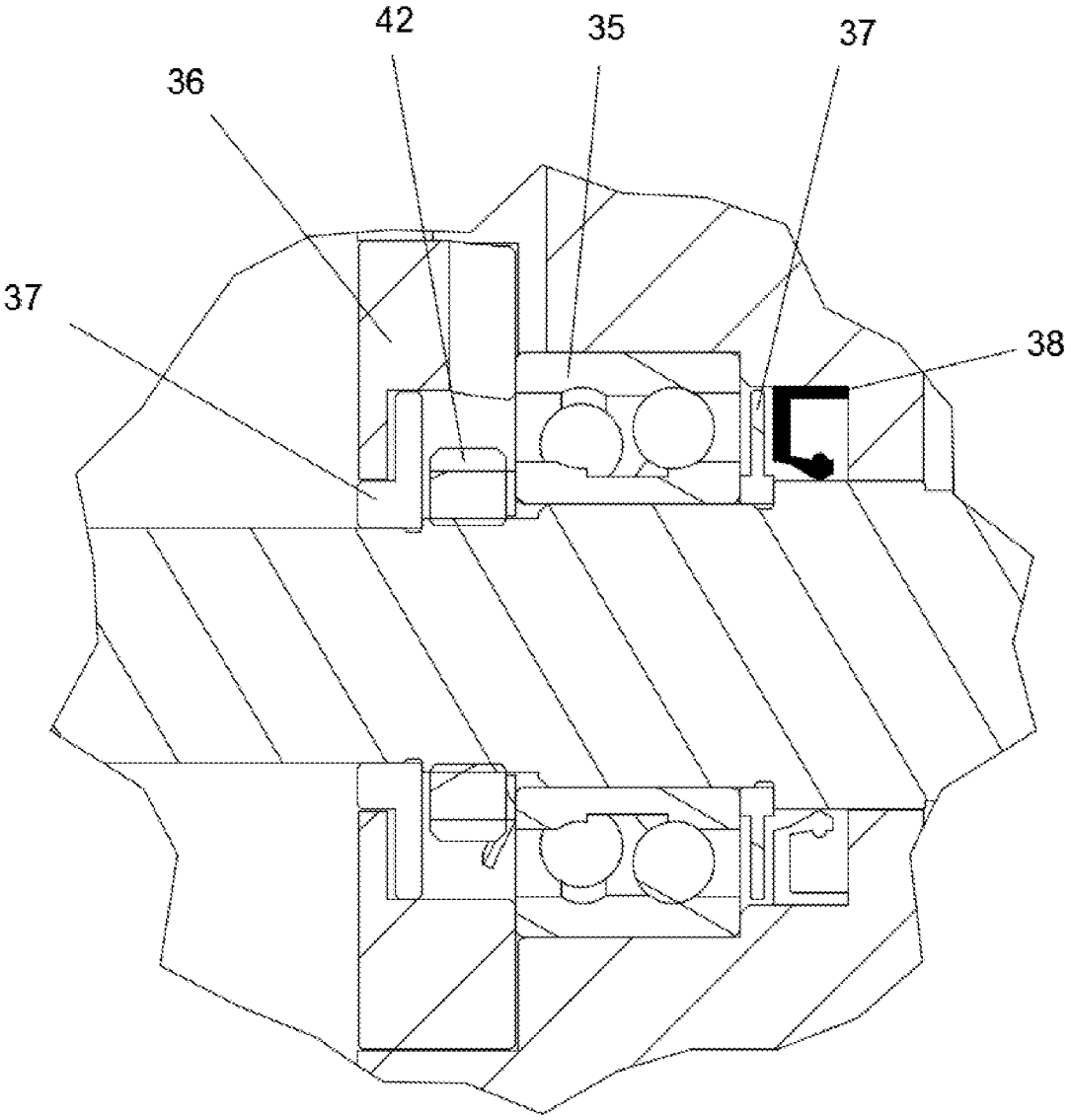
FIG. 5 is a cross-sectional diagram illustrating a fixed bearing limiting unit according to the present invention.

As shown in FIGS. 1-5, a driving structure of a three-axis multi-stage Roots pump comprises a pump body 1, wherein: one side of the pump body 1 is mounted with an air inlet end gear mechanical seal driving unit 2, a gear end cover 3 is mounted on an outer surface of the air inlet end gear mechanical seal driving unit 2, the gear end cover 3 is fixedly mounted on a side end surface of the pump body 1, a motor connecting base 4 is fixedly mounted on the outer surface of the gear end cover 3, the other side of the pump body 1 is mounted with an air outlet end moving bearing air sealing unit 5, a bearing end cover 6 is mounted on the outer surface of the air outlet end moving bearing air sealing unit 5, and the bearing end cover 6 is fixedly mounted on a side end surface of the pump body 1; the pump body 1 is further provided with a driving axis 7, a first driven axis 8 and a second driven axis 9, the first driven axis 8 and the second driven axis 9 are located at both sides of the driving axis 7, respectively, the outer surface of the driving axis 7 is fixedly mounted with a gear 10, the driving axis 7 is in transmission connection with the first driven axis 8 and the second driven axis 9 through the gear 10, respectively; one end of the driving axis 7, the first driven axis 8 and the second driven axis 9 is movably connected to a set of air inlet end gear mechanical seal driving units 2, respectively, and the other end of the driving axis 7, the first driven axis 8 and the second driven axis 9 is movably connected to the set of air outlet end moving bearing air sealing units 5, respectively. The pump body 1 comprises a first-stage pump housing 11, a second-stage pump housing 12 and a three-stage pump housing 13, the first-stage pump housing 11, the second-stage pump housing 12 and the third-stage pump housing 13 are sequentially fixedly connected, the gear end cover 3 is fixedly mounted on the outer surface of the first-stage pump housing 11, the bearing end cover 6 is fixedly mounted on the outer surface of the third-stage pump housing 13, the first-stage pump housing 11 is provided with a first-stage rotor pump chamber 14, the second-stage pump housing 12 is provided with a two-stage rotor pump chamber 15 and a three-stage rotor pump chamber 16, the three-stage pump housing 13 is provided with a four-stage rotor pump chamber 17 and a five-stage rotor pump chamber 18, and the rotors in the first-stage rotor pump chamber 14, the two-stage rotor pump chamber 15, the three-stage rotor pump chamber 16, the four-stage rotor pump chamber 17 and the five-stage rotor pump chamber 18 are all mounted on the driving axis 7, the first driven axis 8 and the second driven axis 9.

Therefore, during operation, the driving axis 7 is driven to rotate by the motor, the gears 10 on the first driven axis 8 and the second driven axis 9 on the left and right sides are driven to synchronously rotate by the gears 10 on the driving axis 7, which in turn drives the first driven axis 8 and the second driven axis 9 to rotate, and the three complete independent axes, that is, the driving axis 7, the first driven axis 8 and the second driven axis 9, synchronously rotate.

Further, each of the independent axes corresponds to one air inlet end gear mechanical seal driving unit 2, respectively, the air inlet end gear mechanical seal driving unit 2 comprises a gear base 19, a mechanical sealing base 20, a mechanical seal ring 21 and a sealing bushing 22, the mechanical sealing base 20 is fixedly mounted on the gear end cover 3 by bolts, the mechanical seal ring 21 is mounted on the sealing bushing 22, each sealing bushing 22 is movably connected to each of the independent axes, respectively; the mechanical seal can block the process air of the first-stage rotor pump chamber 14 from being in contact with the first roller bearing 23 of the unit, the gear 10, and the lubricating oil in the gear lubricating oil tank 41; during operation, the lubricating oil in the gear box may be splashed out due to the stirring action of the gear 10, pass through the oil guiding passage of the mechanical sealing base 20, enter the friction surface between the mechanical sealing base 20 and the mechanical seal ring 21 and provide a lubricating seal. The lubricating oil is also blocked by the mechanical seal ring 21, so that it cannot enter the first-stage rotor pump chamber 14, and the overflowed lubricating oil flows into the first roller bearing 23 through the gap between the mechanical sealing base 20 and the sealing bushing 22 to lubricate the bearing.

The first roller bearing 23 is fixed in the mechanical sealing base 20, one side of the first roller bearing 23 is abutted against the sealing bushing 22, the other side of the first roller bearing 23 is abutted against the gear base 19, the gear base 19 is fixed by a first lock nut 24 and is limited to the end of the driving axis 7, and the gear 10 is fixedly mounted to the gear base 19 by bolts. The gear base 19 is fixed with one end of the driving bushing 25 by bolts and uses a positioning and matching concentric axis for limit with the driving bushing 25, the other end of the driving bushing 25 is matched with a motor connecting axis 26 and a axis key through a keyway, and the motor connecting axis 26 is in transmission connection with the driving axis 7, so that when the motor rotates, the driving bushing 25 is driven to synchronously rotate, and the gear 10 is driven to rotate synchronously, so that the driving axis 7 is driven to synchronously rotate by the gear base 19, which in turn drives the gears 10 on the first driven axis 8 and the second driven axis 9 on the left and right sides to synchronously rotate by the gears 10 on the driving axis 7.

Further, the drive bushing 25 is in sealed connection with the motor connecting base 4 through a third lip seal 40. The third lip seal 40 can prevent the lubricating oil splashed by the gear 10 from flowing out of the motor connecting base 4.

Further, each of the independent axes correspond to a set of moving bearing air sealing units 5, respectively, the moving bearing air sealing unit 5 comprises a dust shielding base 27, a dust shielding bushing 28, a bearing gland 29 and a bearing base 30, the dust shielding base 27 is fixedly mounted on the bearing end cover 6 and cooperates with the dust shielding bushing 28, the dust shielding bushing 28 is sleeved on the driving axis 7, the first driven axis 8 and the second driven axis 9, respectively, a gap is provided between the dust shielding base 27 and the dust shielding bushing 28, an air seal passage is provided on the bearing base 30, the air seal passage is communicated with the gap, a first lip seal 33 is provided between the bearing base 30 and the dust shielding bushing 28, and the bearing gland 29 is fixedly mounted on the outer surface of the bearing base 30. Since the air pressure of the five-stage rotor pump chamber 18 is already higher than the normal pressure, air may infiltrate into the bearing chamber during the air exhausting process, comprising corrosive gas, dust particles, etc. In this way, the dust shielding base 27 is fixed on the bearing end cover 6 and cooperates with the dust shielding bushing 28 to allow compressed air to enter the interior of the dust shielding base 27 through the air seal passage of the bearing base 30 and then enter the gap between the dust shielding base 27 and the dust shielding bushing 28 through the air seal passage of the dust shielding base 27. Since the other side of the independent axis is a completely sealed bearing chamber surrounded by the bearing gland 29 and the bearing base 30, the pressure of the bearing chamber and the air of the five-stage rotor pump chamber 18 maintain a balanced pressure, creating an air curtain that ensures that harmful gas and particulate matter cannot enter the bearing chamber, while also ensuring that lubricating grease is not drawn into the rotor chamber at any time.

Further, a second roller bearing 31 is fixed in the bearing base 30, one side of the second roller bearing 31 is abutted against the dust shielding bushing 28, the other side of the second roller bearing 31 is defined by a second lock nut 32, and the second lock nut 32 is fixedly sleeved on the driving axis 7, the first driven axis 8 and the second driven axis 9, respectively. The outer circumference of the second roller bearing 31 may have an axial displacement, so that the middle of the independent axis is locked by the inner circumference of the second roller bearing 31, and the axial thermal stress and displacement to the bearing end cover 6 will have no influence on the unit component.

Further, the driving structure of a three-axis multi-stage Roots pump further comprises a fixed bearing limiting unit 34. Each of the independent axes corresponds to a set of bearing limiting units 34, respectively. The bearing limiting unit 34 is provided in the first-stage pump housing 11, the fixed bearing limiting unit 34 comprises a ball bearing 35 and a bearing chamber grease shielding ring 37, one end of the outer circumference of the ball bearing 35 is defined in the first-stage pump housing 11, the other end of the outer circumference of the ball bearing 35 is fixed with a bearing chamber grease shielding base 36, the bearing chamber grease shielding base 36 is defined and fixed by the first-stage pump housing 11, one end of the inner circumference of the ball bearing 35 is abutted against the bearing chamber grease shielding ring 37, the bearing chamber grease shielding ring 37 is defined by the axis steps on the surface of the driving axis 7, the first driven axis 8, and the second driven axis 9, the other end of the inner circumference of the ball bearing 35 is defined by a second lock nut 42, and the second lock nut 42 is fixedly mounted on the outer surface of the driving axis 7, the first driven axis 8 and the second driven axis 9, respectively. The ball bearing 35 is a double-row angular contact ball bearing 35. During mounting and operation, the axial displacement of the three independent axes, that is, the driving axis 7, the first driven axis 8 and the second driven axis 9, expands toward the two axial ends with the double-row angular contact ball bearing 35 as a fixing point due to the force or thermal expansion. Therefore, at any time, the rotor and the independent axis in the first-stage rotor pump chamber 14 can only be axially displaced toward the gear end cover 3. The rotor and the independent axis in the two-stage rotor pump chamber 15, the three-stage rotor pump chamber 16, the four-stage rotor pump chamber 17, and the five-stage rotor pump chamber 18 can only be axially displaced to the non-driving end gear end cover 3. That is, at the center of the axis, a fixed bearing limiting unit 34 is provided, which not only plays a radial supporting role, strengthens the rigidity of an independent axis, but also reduces the diameter of the axis, and at the same time, evenly distributes to the two axial ends in the force and thermal axial deformation process, avoiding deformation in a single direction, reducing the amount of displacement by nearly half, greatly reducing the end face gap reserved between the rotor and the rotor chamber in the rotor pump chamber, thereby not only improving the stability of the structure, reducing the hidden danger of the rubbing, but also improving the sealing efficiency of the system (the larger the gap, the greater the leakage).

Further, a second lip seal 38 is mounted between the bearing chamber grease shielding ring 37 and the first-stage pump housing 11. Since the air pressure of the second-stage rotor pump chamber 15 is slightly higher than the pressure of the first-stage rotor pump chamber 14 in actual operation, the lubricating grease in the chamber of the double-row angular contact ball bearing 35 will not be drawn into the second-stage rotor pump chamber 15. The second lip seal 38 is mounted only at the first-stage rotor pump chamber 14 to prevent the lubricating grease from being drawn into the first-stage rotor pump chamber 14. In actual operation, since the bearing here is wrapped by a large amount of cooling water, the heat dissipation is good, and the lubricating grease will maintain a certain viscosity, the bearing can be effectively fixed in the bearing chamber for a long time.

Further, the surface of the bearing chamber grease shielding base 36 is provided with a guiding notch, the first-stage pump housing 11 is provided with a lubricating grease inspection hole 39, and the lubricating grease inspection injection hole 39 is communicated with the guiding notch so as to observe the lubricating grease in real time and replenish the lubricating grease.

The above embodiments are merely used to illustrate the technical solutions of the present invention, and are not intended to be limiting; although the present invention has been described in detail with reference to the above embodiments, it will be understood by those of ordinary skill in the art that the technical solutions described by the above embodiments are modified, or some of its technical features are equivalently replaced. However, these modifications or replacements do not cause the essence of the corresponding technical solutions to depart from the spirit and scope of the technical solutions of various embodiments of the present invention.

What is claimed is:

1. A three-axis multi-stage Roots pump comprising:

a pump body (1), wherein a first side of the pump body (1) is mounted with an air inlet end gear mechanical seal driving unit (2);

a gear end cover (3) mounted on an outer surface of the air inlet end gear mechanical seal driving unit (2), the gear end cover (3) being fixedly mounted on a side end surface of the pump body (1);

a motor connecting base (4) fixedly mounted on an outer surface of the gear end cover (3);

an air outlet end moving bearing air sealing unit (5) mounted on a second side of the pump body (1) opposite said first side of the pump body (1);

a bearing end cover (6) mounted on an outer surface of the air outlet end moving bearing air sealing unit (5), wherein the bearing end cover (6) is fixedly mounted on a side end surface of the pump body (1);

wherein the pump body (1) is further provided with a driving axis (7), a first driven axis (8) and a second driven axis (9); wherein the first driven axis (8) and the second driven axis (9) are located on opposite sides of the driving axis (7), respectively; wherein outer surfaces of the driving axis (7), the first driven axis (8) and the second driven axis (9) are each fixedly mounted with a respective gear (10), the gear (10) on the outer surface of the driving axis (7) meshes with the gear (10) on the outer surface of the first driven axis (8), and the gear (10) on the outer surface of the second driven axis (9), respectively; wherein a first end of the driving axis (7), a first end of the first driven axis (8), and first end of the second driven axis (9) are each movably connected to the air inlet end gear mechanical seal driving unit (2); wherein a second end of the driving axis (7) opposite the first end of the driving axis (7), a second end of the first driven axis (8) opposite the first end of the first driven axis (8), and a second end of the second driven axis (9) opposite the first end of the second drive axis are each movably connected to the air outlet end moving bearing air sealing unit (5); and wherein the moving bearing air sealing unit (5) comprises:

a dust shielding base (27);

a dust shielding bushing (28);

a bearing gland (29); and a bearing base (30);

wherein the dust shielding base (27) is fixedly mounted on the bearing end cover (6) and cooperates with the dust shielding bushing (28); wherein the dust shielding bushing (28) is sleeved on the driving axis (7), the first driven axis (8), and the second driven axis (9), respectively; wherein a gap is provided between the dust shielding base (27) and the dust shielding bushing (28); wherein an air seal passage is provided on the bearing base (30), and wherein the air seal passage is in communication with the gap; wherein a first lip seal (33) is provided between the bearing base (30) and the dust shielding bushing (28); and wherein the bearing gland (29) is fixedly mounted on an outer surface of the bearing base (30).

2. The three-axis multi-stage Roots pump according to claim 1, wherein the pump body (1) further comprises:

a first-stage pump housing (11), a second-stage pump housing (12), and a three-stage pump housing (13);

wherein the first-stage pump housing (11), the second-stage pump housing (12), and the third-stage pump housing (13) are sequentially fixedly connected, the gear end cover (3) is fixedly mounted on the outer surface of the first-stage pump housing (11); wherein the bearing end cover (6) is fixedly mounted on an outer surface of the third-stage pump housing (13); wherein the first-stage pump housing (11) is provided with a first-stage rotor pump chamber (14), the second-stage pump housing (12) is provided with a two-stage rotor pump chamber (15) and a three-stage rotor pump chamber (16), and the three-stage pump housing (13) is provided with a four-stage rotor pump chamber (17) and a five-stage rotor pump chamber (18); and wherein rotors in the first-stage rotor pump chamber (14), rotors inside the two-stage rotor pump chamber (15), rotors inside the three-stage rotor pump chamber (16), rotors inside the four-stage rotor pump chamber (17), and rotors inside the five-stage rotor pump chamber (18) are all mounted on the driving axis (7), the first driven axis (8), and the second driven axis (9).

3. The three-axis multi-stage Roots pump according to claim 2, further comprising:

a fixed bearing limiting unit (34), wherein the fixed bearing limiting unit (34) is provided in the first-stage pump housing (11); and wherein the fixed bearing limiting unit (34) comprises:

a ball bearing (35), and a bearing chamber grease shielding ring (37);

wherein a first end of an outer circumference of the ball bearing (35) is defined in the first-stage pump housing (11) and wherein a second side of the outer circumference of the ball bearing (35) is fixed with a bearing chamber grease shielding base (36); wherein the bearing chamber grease shielding base (36) is defined and fixed by the first-stage pump housing (11); wherein a first end of an inner circumference of the ball bearing (35) is abutted against the bearing chamber grease shielding ring (37); wherein the bearing chamber grease shielding ring (37) is defined by axis steps on the outer surfaces of the driving axis (7), the first driven axis (8), and the second driven axis (9), respectively; and wherein a second end of the inner circumference of the ball bearing (35) is defined by a second lock nut (42), and wherein the second lock nut (42) is fixedly mounted on the outer surfaces of the driving axis (7), the first driven axis (8), and the second driven axis (9), respectively.

4. The three-axis multi-stage Roots pump according to claim 3, wherein a second lip seal (38) is mounted between the beating chamber grease shielding ring (37) and the first-stage pump housing (11).

5. The three-axis multi-stage Roots pump according to claim 3, wherein a surface of the bearing chamber grease shielding base (36) is provided with a guiding notch, wherein the first-stage pump housing (11) is provided with a lubricating grease inspection hole (39), and wherein the lubricating grease inspection injection hole (39) is in communication with the guiding notch.

6. The three-axis multi-stage loots pump according to claim 1, wherein the air inlet end gear mechanical seal driving unit (2) comprises:

a gear base (19);

a mechanical sealing base (20);

a mechanical seal ring (21); and a sealing bushing (22);

wherein the mechanical sealing base (20) is fixedly mounted on the gear end cover (3) by bolts; wherein the mechanical seal ring (21) is mounted on the sealing bushing (22); wherein each sealing bushing (22) is movably connected to the driving axis (7), the first driven axis (8), and the second driven axis (9), respectively; and wherein a first roller bearing (23) is fixed in the mechanical sealing base (20), wherein a first side of the first roller bearing (23) is abutted against the sealing bushing (22) and the second side of the first roller bearing (23), opposite said first side of the first roller bearing (23), is abutted against the gear base (19) and wherein the gear base (19) is fixed by a first lock nut (24) and is limited to the end of the driving axis (7), and the gears (10) of the driving axis (7) are fixedly mounted to the gear base (19) by bolts.

7. The three-axis multi-stage Roots pump according to claim 6, wherein the gear base (19) is fixed with a first end of a driving bushing (25) by bolts and uses a positioning and matching concentric axis for limit with the driving bushing (25), a second end of the driving bushing (25) is matched with a motor connecting axis (26) and a axis key through a keyway, and wherein the motor connecting axis (26) is in a transmission connection with the driving axis (7).

8. The three-axis multi-stage Roots pump according to claim 7 wherein the driving bushing (25) is in a sealed connection with the motor connecting base (4) through a third lip seal (40).

9. The three-axis multi-stage Roots pump according to claim 1, wherein a second roller bearing (31) is fixed in the bearing base (30), and wherein a first side of the second roller bearing (31) is abutted against the dust shielding bushing (28) and wherein a second side of the second roller bearing (31), opposite said first side of the second roller bearing (310), is defined by a second lock nut (32), and wherein the second lock nut (32) is fixedly sleeved on the driving axis (7), the first driven axis (8), and the second driven axis (9), respectively.

10. A three-axis multi-stage Roots pump comprising:

a pump body (1), wherein a first side of the pump body (1) is mounted with an air inlet end gear mechanical seal driving unit (2);

a gear end cover (3) mounted on an outer surface of the air inlet end gear mechanical seal driving unit (2); the gear end cover (3) being fixedly mounted on a side end surface of the pump body (1);

a motor connecting base (4) fixedly mounted on an outer surface of the gear end cover (3);

an air outlet end moving bearing air sealing unit (5); mounted on a second side of the pump body (1) opposite said first side of the pump body (1);

a bearing end cover (6) mounted on an outer surface of the air outlet end moving bearing air sealing unit (5), wherein the bearing end cover (6) is fixedly mounted on a side end surface of the pump body (1);

wherein the pump body (1) is further provided with a driving axis (7), a first driven axis (8) and a second driven axis (9); wherein the first driven axis (8) and the second driven axis (9) are located on opposite sides of the driving axis (7), respectively; wherein outer surfaces of the driving axis (7), the first driven axis (8) and the second driven axis (9) are each fixedly mounted with a respective gear (10), the gear (10) on the outer surface of the driving axis (7) meshes with the gear (10) on the outer surface of the first driven axis (8), and the gear (10) on the outer surface of the second driven axis (9), respectively; wherein a first end of the driving axis (7), a first end of the first driven axis (8), and first end of the second driven axis (9) are each movably connected to the air inlet end gear mechanical seal driving unit (2); wherein a second end of the driving axis (7) opposite the first end of the driving axis (7), a second end of the first driven axis (8) opposite the first end of the first driven axis (8), and a second end of the second driven axis (9) opposite the first end of the second drive axis are each movably connected to the air outlet end moving bearing air sealing unit (5); and wherein the air inlet end gear mechanical seal driving unit (2) comprises:

a gear base (19);

a mechanical sealing base (20);

a mechanical seal ring (21); and a sealing bushing (22);

wherein the gear base (19) is fixed with a first end of a driving bushing (25) by bolts and uses a positioning and matching concentric axis for limit with the driving bushing (25), a second end of the driving bushing (25) is matched with a motor connecting axis (26) and an axis key through a keyway, and wherein the motor connecting axis (26) is in a transmission connection with the driving axis (7).

* * * * *